United States Patent [19]

Stumpf

[11] Patent Number: 4,887,912

[45] Date of Patent: Dec. 19, 1989

[54] STAND-UP BAG

[75] Inventor: Friedrich Stumpf, Meckesheim, Fed. Rep. of Germany

[73] Assignee: Indag Gesellschaft fur Industriebedarf m.b.H., Heidelberg, Fed. Rep. of Germany

[21] Appl. No.: 298,956

[22] Filed: Jan. 19, 1989

[30] Foreign Application Priority Data

Jan. 19, 1988 [DE] Fed. Rep. of Germany ... 8800575[U]

[51] Int. Cl.[4] ..... B65D 39/08

[52] U.S. Cl. ..... 383/66; 383/80

[58] Field of Search ..... 383/66, 80, 96, 901, 383/904; 128/400

[56] References Cited

U.S. PATENT DOCUMENTS

| | | | |
|---|---|---|---|
| 1,509,137 | 9/1924 | Gottlieb | 383/80 |
| 1,607,314 | 11/1926 | Schweinert | 383/80 |
| 1,769,259 | 7/1930 | Henry | 383/80 |
| 2,687,158 | 8/1954 | Owen | 383/66 |
| 2,777,490 | 1/1957 | Munk | 383/66 |
| 3,108,732 | 10/1963 | Curie et al. | 383/66 |
| 3,604,491 | 9/1971 | Spiess | 383/80 |
| 4,542,530 | 9/1985 | Thomas et al. | 383/66 |
| 4,658,434 | 4/1987 | Murray | 383/66 |
| 4,672,688 | 6/1987 | Kalkipsakis | 383/66 |

FOREIGN PATENT DOCUMENTS

| | | | |
|---|---|---|---|
| WO84/04037 | 10/1984 | PCT Int'l Appl. | 383/7 |
| 0608123 | 9/1948 | United Kingdom | 383/66 |

*Primary Examiner*—Stephen Marcus
*Assistant Examiner*—Kathryn M. Stemann
*Attorney, Agent, or Firm*—Birch, Stewart, Kolasch & Birch

[57] ABSTRACT

A bag for containing liquid products, for example, is made of a heat-weldable sheet material. The sheet material may suitably be a compound sheet material which provides a rear face, a front face and an insert bottom. Disposed at an upper portion of the front or rear face is a threaded closure comprising a screw-threaded pipe socket and a screw cap. The pipe socket penetrates one face of the bag and is bonded to the interior surface of the bag with the aid of a welding flange having a larger diameter. The welding flange has a chamfered outer rim cooperating with the sheet material to form a V-shaped circumferential groove which is at least partially filled with the molten plastic material of the sheet during the welding operation. The threaded closure permits the bag to be repeatedly opened and closed for piecemeal dispensing its contents.

7 Claims, 1 Drawing Sheet

STAND-UP BAG

BACKGROUND OF THE INVENTION

The present invention relates to a stand-up bag made of a heat-weldable sheet material. More particularly, the bag comprises a front face and a rear face connected to one another along their edges, with either the front face or the rear face being provided with a reclosable threaded closure which includes a pipe socket formed with screw threads for engagement with screw threads of a removable screw cap.

So-called one-way bags are known for various practical uses. They are employed for instance for containing beverages, in which case such bags are frequently designed as single-dose bags for containing a quantity of a beverage for consumption by the user upon a single occasion. The front face of bags of this type is usually formed with a weakened portion adapted to be pierced by a drinking-straw which is then used for extracting the liquid content from the bag. Depending on the liquid contents of such bags, it is also customary for such bags to be cut open to enable them to be emptied of their contents. Bags of this type can be readily disposed of, as they assume only a very small volume when empty. On the other hand, however, the consumer is always compelled to empty the bag completely, be it by drinking all of its contents or, in the case of non-potable liquids, by decanting all of its contents because bags of this type are not-reclosable.

A stand-up bag of the type defined in the introduction is known from German Patent Document DE-OS 17 86 019. One flat side of this bag is provided with a threaded closure secured to the outer surface of the bag by means of a flange. In the case of stand-up bags of this type there is always the danger of leakage. This is because the torque created on reclosing the threaded closure could result in the bag being damaged since excessive torque sometimes results.

SUMMARY OF THE INVENTION

It is therefore an object of the present invention to provide a stand-up bag of the type defined in the introduction, with the pipe socket secured to the bag in such a manner that its connection to the bag is able to resist the forces created by tightening and unscrewing the screw cap, thereby avoiding leakage of the bag.

This object is attained according to the invention by an arrangement wherein the pipe socket of the threaded closure penetrates the bag and has its inner end secured to the inner wall surface of the bag with the aid of a welding flange having a chamfered outer rim cooperating with the associated face of the bag to form a radially outwardly opening V-shaped circumferential groove which is at least partially filled with a sealing layer formed by melting during the welding operation.

Although there is known from U.S. Pat. No. 4,542,530 a flexible container provided with a faucet, with the socket of the faucet secured to a wall of the bag from the interior thereof, this type of connection is not capable of resisting the forces created by tightening and unscrewing a screw cap. Moreover, this type of connection is not even necessary in the case of a bag according to the noted U.S. Patent, because the bag is provided with a metering faucet or tap, the operation of which requires considerably smaller forces.

By the solution according to the present invention it was unexpectedly possible to obtain a particularly effective dissipation of the torque created by tightening and unscrewing the screw cap in the front or rear face of the bag. When the welding flange is welded to the sheet material of the bag, the V-shaped groove formed by the chamfered edge is effective to collect therein the molten material, so that a particularly resistant connection is established between the bag material and the welding flange along the rim of the latter. This is particularly important, because it is at the edge of the welding flange where the torque created by actuation of the threaded closure is introduced into the front or rear face of the sheet material bag. The thickness of the sheet material may be suitably selected to correspond to the size of the welding flange.

It has been found to be particularly advantageous to form the chamfered edge of the flange with an angle of inclination of about 45°.

Particularly in the case where a relatively thin compound sheet material is utilized the diameter of the welding flange is advantageously selected to be at least twice the diameter of the pipe socket for readily resisting the torque executed by the threaded closure.

According to another advantageous aspect of the present invention, the lower portion of the bag is provided with an insert bottom, and the threaded closure is located at an upper portion of the bag. Apart from facilitating the extraction of the bag's contents, this arrangement of the threaded closure offers the advantage that the threaded closure is disposed at a location where either the front face or the rear face of the bag is bordered by reinforcing weld seams on three sides, thereby improving the strength of the bag at the threaded closure location. Even the exertion of relatively great torques, for instance when the threaded closure is opened for the first time, will not, or will only to a still acceptable degree, cause the sheet material to be distorted. This permits the thickness of the compound sheet material to be further reduced, depending on the distance between the weld seams and the welding flange of the threaded closure.

BRIEF DESCRIPTION OF THE DRAWINGS

An embodiment of the invention shall now be described by way of example with reference to the accompanying drawings, wherein.

DETAILED DESCRIPTION OF PREFERRED EMBODIMENTS

Figure 1:
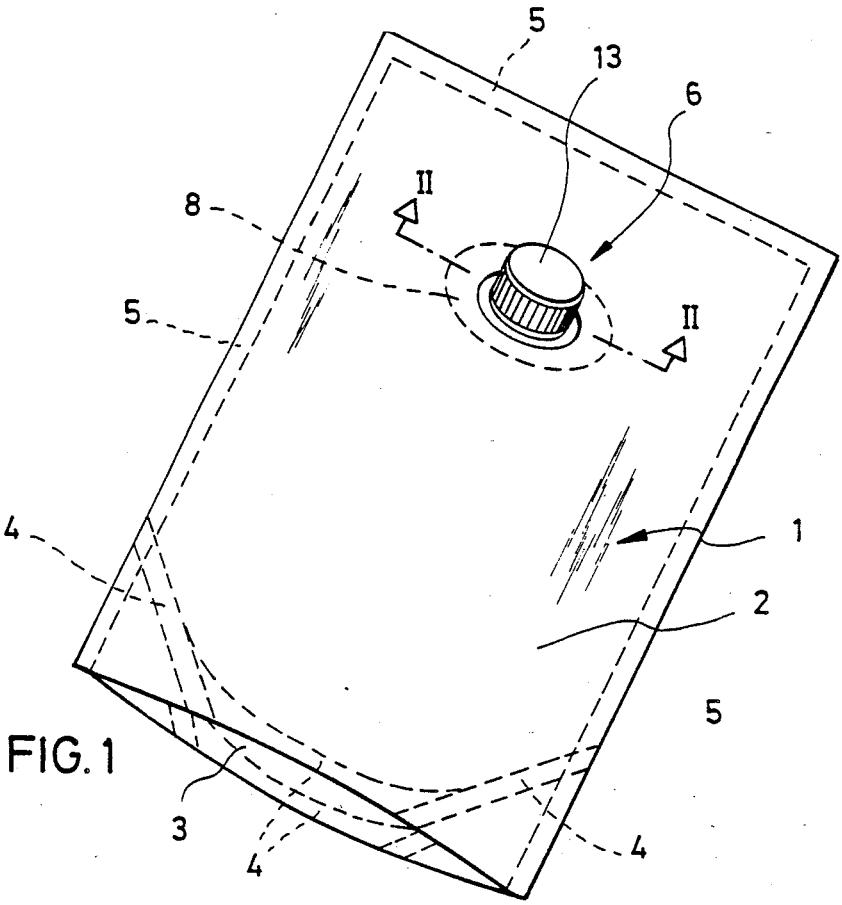
FIG. 1 shows a perspective front view of a stand-up bag according to the invention.

Shown in FIG. 1 is a perspective view of a stand-up bag according to the invention. The stand-up bag is made of a heat-weldable compound sheet material 1. In the present example a three-layered sheet material comprising a heat-weldable inner plastic layer 10, an aluminum layer 11, and an outer plastic layer 12 is utilized. The bag has a front face 2 and a rear face not shown in detail in FIG. 1. Inserted into a lower end portion of the bag is a bottom 3 connected to front face 2 and the rear face by weld seams 4. Upwards of bottom 3 the rear face is likewise connected to front face 2 by weld seams 5. Welding of front face 2, bottom 3 and the rear face to one another is carried out in the conventional manner by the action of heat and pressure.

As clearly shown in FIG. 1, an upper portion of the bag is provided with a reclosable opening 6, which provides access to the interior of the bag. As shown more clearly in FIG. 2, opening 6 is formed as a threaded closure with a pipe socket 7 penetrating the bag, or rather, in this example, front face 2, to project outwards therefrom. The inner end of pipe socket 7 has a welding flange 8 by means of which is it secured to the inner wall surface 9 of the bag.

Pipe socket 7 is provided with outer screw threads for engagement with inner screw threads of a removable screw cap 13.

Figure 2:
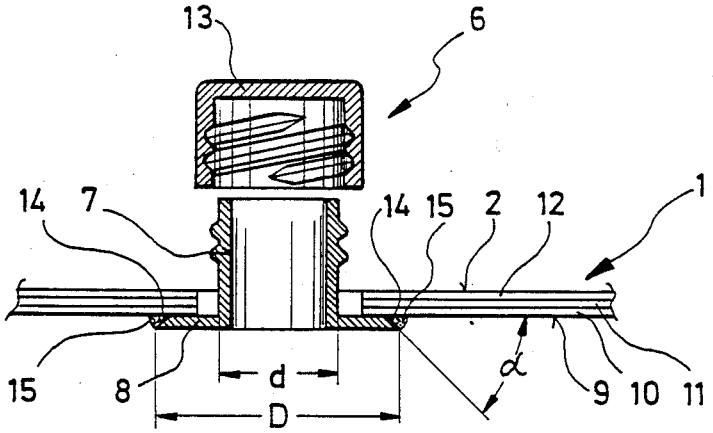
FIG. 2 shows a sectional view of the front face of the bag taken along the line II—II in FIG. 1.

FIG. 2 shows screw cap 13 in an unscrewed position separate from pipe socket 7.

The threaded closure is illustrated as being secured to front face 2 of the bag by welding heat-weldable plastic layer 10 of compound sheet 1 to welding flange 8 of the threaded closure. However, the threaded closure can be secured to the rear face if it is so desired.

The outer edge 14 of welding flange 8 is chamfered in such a manner that it cooperates with the associated side of the bag, i.e. front face 2, to form a radially outwards opening V-shaped circumferential groove 15. The angle of inclination of chamfered rim 14 is preferably about 45°.

When compound sheet 1 is welded onto welding flange 8, plastic layer 10 is molten. Part of the thus molten plastic layer is displaced radially outwards so as to at least partially fill circumferential groove 15. The V-shape of circumferential groove 15 results in the formation of a converging gap effective to attract the molten plastic material. This results in a particularly intimate bond between outer rim 14 of welding flange 8 and compound sheet 1.

The diameter D of welding flange 8 is at least twice the diameter d of pipe socket 7. In the embodiment shown by way of example, diameter D is even 2.5 times as great as diameter d.

The effect of the invention and the advantages obtained thereby shall now be explained with reference to opening and closing the threaded closure of the stand-up bag.

Proceeding from the state shown in FIG. 2, when the threaded closure is closed by tightening screw cap 13 on pipe socket 7, a torque is generated which has to be transmitted to front face 2 of the stand-up bag by welding flange 8. In order to restrict any distortion of the bag as much as possible, and to avoid any leakage which might otherwise be caused thereby, it is particularly important that the radial distance between the outer rim of the welding flange and the center of threaded closure 6 be as great as possible. This can be achieved by selecting the diameter D of welding flange 8 as great as possible, although the desired effect can only be obtained when it is ensured that welding flange 8 is fixedly bonded to compound sheet 1 up to and including rim 14. Otherwise the selection of a great diameter D would not be very helpful.

By the provision of chamfered rim 14 and the circumferential groove 15 resulting therefrom it is ensured that the plastic material of plastic layer 10 in its molten state enters groove 15 to result in an intimately welded bond between outer rim 14 of welding flange 8 and the plastic layer of compound sheet 1. As a result of this provision, it becomes economically advantageous to equip stand-up bags with threaded closures, because it is possible to inexpensively obtain a high degree of reliability as concerns the sealing properties of the closure and the torque-resistance property of the connection between compound sheet 1 and threaded closure 6.

Similarly, the torque created by opening the threaded closure is absorbed in the same manner by front face 2 of the bag. Stand-up bags of the type described are particularly suitable for packaging liquids of any kind.

The screw cap of the threaded closure may of course be provided with a known pilferproof arrangement or warranty ring, so that it is possible to ascertain whether the threaded closure has already been previously opened.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A stand-up bag made of a heat-weldable sheet material, said bag comprising:
   - a front face and a rear face connected to one another along their edges,
   - a reclosable threaded closure provided on one of said faces,
   - said reclosable threaded closure including a pipe socket formed with screw threads for engagement with screw threads of a removable screw cap,
   - said pipe socket of said threaded closure penetrating the bag and having its inner end secured to an inner wall surface of the bag with the aid of a welding flange,
   - said welding flange having a chamfered outer rim which forms with said inner wall surface a radially outwardly opening v-shaped circumferential groove, and
   - said groove being at least partially filled by a sealing layer formed by melting during the welding operation.

2. A stand-up bag according to claim 1, wherein the angle of inclination of said chamfered outer rim is about 45°.

3. A stand-up bag according to claim 1, wherein the diameter of said welding flange is at least twice the diameter of said pipe socket.

4. A stand-up bag according to claim 2, wherein the diameter of said welding flange is at least twice the diameter of said pipe socket.

5. A stand-up bag according to claim 1, wherein a lower portion of said bag is formed with an insert bottom and said threaded closure is located at an upper portion of the bag.

6. A stand-up bag according to claim 2, wherein a lower portion of said bag is formed with an insert bottom and said threaded closure is located at an upper portion of the bag.

7. A stand-up bag according to claim 3, wherein a lower portion of said bag is formed with an insert bottom and said threaded closure is located at an upper portion of the bag.

* * * * *